US010493506B2

(12) United States Patent
Kim

(10) Patent No.: US 10,493,506 B2
(45) Date of Patent: Dec. 3, 2019

(54) INHALATION DEVICE FOR LOCAL VENTILATION SYSTEM

(71) Applicant: JEJIN ENGINEERING CO., LTD., Gyeonggi-do (KR)

(72) Inventor: Hyung Ryer Kim, Gangwon-do (KR)

(73) Assignee: JEJIN ENGINEERING CO., LTD., Suwon-si (KR)

( * ) Notice: Subject to any disclaimer, the term of this patent is extended or adjusted under 35 U.S.C. 154(b) by 27 days.

(21) Appl. No.: 15/334,949

(22) Filed: Oct. 26, 2016

(65) Prior Publication Data

US 2018/0056343 A1 Mar. 1, 2018

(30) Foreign Application Priority Data

Aug. 31, 2016 (KR) ..... 10-2016-0111333

(51) Int. Cl.

| | |
|---|---|
| ***B08B 15/02*** | (2006.01) |
| ***F24C 15/20*** | (2006.01) |
| ***F24F 7/06*** | (2006.01) |

(52) U.S. Cl.

CPC ..... *B08B 15/023* (2013.01); *B08B 15/02* (2013.01); *F24C 15/20* (2013.01); *F24F 7/065* (2013.01)

(58) Field of Classification Search

CPC ... F24C 15/20; F24F 11/04; F24F 3/16; F24F 2013/088; F24F 7/065; B01L 1/04;

(Continued)

(56) References Cited

U.S. PATENT DOCUMENTS 2,106,458 A * 1/1938 Kurth ..... F24F 13/062 454/309
3,699,876 A * 10/1972 Ellis ..... A47J 37/0704 126/25 R (Continued)

FOREIGN PATENT DOCUMENTS

JP 2004293961 A * 10/2004
JP 2006208404 A * 8/2006

(Continued)

OTHER PUBLICATIONS

Title: Local Exhaust Hood Suction Device for Industry and Exhaust System Comprising Thereof Patent No. KR 101474822 B1 Publication Date: Dec. 2014 Inventor: Jin Nam Gi.*

(Continued)

*Primary Examiner* — Kenneth Rinehart
*Assistant Examiner* — Phillip Decker
(74) *Attorney, Agent, or Firm* — Maschoff Brennan

(57) ABSTRACT

Embodiments of the invention provide an intake apparatus for a local ventilation system. According to at least one embodiment, the intake apparatus includes a connection opening, a hood configured to connect an intake opening larger than the connection opening, an intake duct coupled to the hood while communicating with the connection opening, and an intake fan which is installed at a peripheral portion of the intake opening so as to generate an intake air current in the direction of the connection opening. According to at least one embodiment, the intake fan is provided multiple in number in the circumference direction of the intake opening to generate an intake air current flowing from the intake opening to the connection opening, and a mixed flow prevention body is formed protruding in a partition shape from the intake opening to the intake duct along the inner side of a corner of the hood, and a plurality of lattice exhaust guide flow passages are disposed on straight lines (Continued)

and are isolated from each other, and an air current alignment lattice is installed in the inner space of the intake duct for the lattice exhaust guide flow passage to be disposed in the longitudinal direction of the intake duct.

3 Claims, 13 Drawing Sheets

(58) Field of Classification Search
CPC ... B01L 1/00; G21F 7/015; G21F 7/00; B08B 15/023; B08B 15/02; F15B 2211/40523
USPC ..... 454/57, 58, 343; 126/299 D
See application file for complete search history.

(56) References Cited

U.S. PATENT DOCUMENTS 3,759,579 A * 9/1973 Johnston ..... B65G 53/18 406/88
4,548,128 A * 10/1985 Morikawa ..... B08B 15/023 454/56
5,035,067 A * 7/1991 Bergquist ..... B01D 1/18 34/231
5,078,574 A * 1/1992 Olsen ..... F04D 19/002 415/182.1
5,549,512 A * 8/1996 Sinclair ..... B01L 1/04 454/57
5,716,268 A * 2/1998 Strongin ..... B08B 15/02 454/189
5,759,096 A * 6/1998 Berlin ..... B08B 15/023 454/56
5,989,119 A * 11/1999 Raisanen ..... A01K 1/0052 454/239
7,303,730 B2 * 12/2007 Shishido ..... B01D 53/86 138/37
7,566,264 B2 * 7/2009 Votaw ..... F24F 13/14 251/5
7,828,522 B2 * 11/2010 Weaver ..... F04D 29/541 415/213.1
8,147,193 B2 * 4/2012 Weaver ..... F04D 25/12 415/213.1
2009/0032011 A1 * 2/2009 Livchak ..... F24C 15/20 126/299 D
2011/0287706 A1 * 11/2011 Maughan ..... F24F 13/08 454/329
2015/0198468 A1 * 7/2015 Brugger ..... G01F 1/05 73/861
2019/0134684 A1 * 5/2019 Gonzalez ..... B08B 15/02

FOREIGN PATENT DOCUMENTS

KR 10-0155025 B1 12/1998
KR 20140088491 A * 7/2014
KR 10-1474822 B1 12/2014

OTHER PUBLICATIONS

ULINE Long Divider, May 22, 2015, downloaded from https://web.archive.org/web/20150522025832/http://www.uline.com/Product/Detail/S-16975LD/Plastic-Bins/Long-Divider-9-x-5 (Year: 2015).*

* cited by examiner

INHALATION DEVICE FOR LOCAL VENTILATION SYSTEM

CROSS-REFERENCE TO RELATED APPLICATION

This application claims the benefit of and priority to Korean Patent Application No. 10-2016-0111333, filed on Aug. 31, 2016, in the Korean Intellectual Property Office, the disclosure of which is incorporated herein by reference in its entirety.

BACKGROUND

Field

Embodiments of the invention relate to an intake apparatus for a local ventilation system, and in particular to an intake apparatus, which may be used as a part of a local ventilation system, which is able to collect harmful contaminants and discharge the collected harmful contaminants to the outside.

Description of the Related Art

The local ventilation system, in general, is installed and used at an indoor space where contaminants, for example, a dust, a gas, etc., which are harmful to a human body and contaminate environment. The local ventilation system is able to collect such harmful contaminants and discharge the collected harmful contaminants to the outside.

The aforementioned local ventilation system is formed of an intake apparatus for generating an intake air current and sucking contaminants, an exhaust duct connected to the intake apparatus, an exhaust pipe connected to the exhaust duct, and an exhaust fan which is configured to provide a ventilation force to the air containing, harmful contaminants sucked through the intake apparatus in order for the harmful contaminants to be forcibly discharged to the outside through the exhaust duct and the exhaust pipe in sequence.

Moreover, the local ventilation system further includes an air purification apparatus between the intake apparatus and the exhaust pipe, by which the harmful contaminants contained the air sucked through the intake apparatus can be eliminated.

FIG. 13 is a perspective view illustrating a conventional intake apparatus for a local ventilation system, and FIG. 14 is a cross sectional view illustrating the region of a hood and an isolation plate of an intake apparatus for a conventional local ventilation system, and FIG. 15 is a view illustrating an intake fan of a conventional intake apparatus for a local ventilation system.

As illustrated in the drawing, the conventional intake apparatus for a local ventilation system is formed of a connection opening 110*b*, a hood 110 formed to connect the intake opening 110*a*, an intake duct 151 coupled to the hood 110, an isolation plate 157 installed inside of the hood 110, and four intake fans 120 installed at the periphery of the intake opening 110*a*.

The intake opening 110*a* of the hood 110 is formed in a rectangular shape larger than the connection opening 110*b*.

The intake duct 151 is formed in a rectangular shape.

The intake duct 151 is coupled to the hood 110 while communicating with the connection opening 110*b*.

The isolation plate 157 is installed over the whole regions of the inner surface of the hood 110 in a state where it is spaced apart from the inner surface of the hood 110 by means of a plate-shaped spacing member 158. The installation of the isolation plate 157 contributes to the formation of a contacting opening (A) between the connection openings 110*b*.

Each intake fan 120 includes a fan driving motor 121, and an impeller 122 installed at both sides of the fan driving motor 121 to rotate together when a motor shaft rotates.

Each of the thusly constituted intake fan 120 is installed one by one inside of four fan housings 124.

A filter 159 is installed inside of the fan housing 124.

The fan housings 124 are installed at the hood 110 in order for an inflow opening 124*a* and a discharge opening 124*b* installed separate on two planes to be disposed in parallel at the intake opening 110*a*. The fan housings 124 are installed one by one at tour sides of the intake opening 110*a*.

Each intake fan 120 is installed inside of the fan housing 124 so that the motor shaft of the fan driving motor 121 can be disposed in the longitudinal direction of the fan housing 124.

When a driving voltage is supplied, the fan driving motor 121 operates while allowing the impeller 122 to rotate in the arrow direction indicated in FIG. 13. Each intake fan 120 is able to generate an intake air current in the direction from the intake opening 110*a* to the connection opening 110*b*.

The conventional intake apparatus for a local ventilation system is installed in such a way that the intake opening 110*a* and the connection opening 110*b* of the hood 110 are disposed in parallel on the floor of a building and operates as follows.

First, a driving voltage is supplied to the fan driving motor 121. If the driving voltage is supplied to the fan driving motor 121, an intake air current generates by each intake fan 120 in the direction from the intake opening 110*a* to the connection opening 110*b*.

The intake air current generated by each intake fan 120 enters into the inside of the intake duct 151 via the connection opening 110*b*.

When the intake air current generated by each intake fan 120 enters into the inside of the intake duct 151 via the connection opening 110*b*, the speed that the intake air current enters into the inside of the intake duct 151 becomes fast by means of a negative pressure creating at the contacting opening (A).

According to the conventional intake apparatus for a local ventilation system, each intake air current which has been generated by each intake fan 120 and has reached the connection opening 110*b* along the inner surface of the isolation plate 157 crosses each other at the connection opening 110*b* (the size of the intake opening where the intake fan is installed, is larger than the connection opening), the air current may collide while creating interference before it enters the intake duct 151 and after it has entered the intake duct 151, for which an eddy current may occur at the mouth of the intake duct 151. Whenever the air current changes, the eddy current or drift current occurs, thus causing a problem. For this reason, the air flow speed may decrease inside the intake duct 151, and the Whole exhaust efficiency of the local ventilation system will be degraded.

As the related prior art documents, there is the Korean patent registration number 10-1474822 (the date of the registration is Dec. 15, 2014, and the title of the invention is a local hood intake apparatus for industry and an exhaust system to which multiple local exhaust hood intake apparatuses are adapted for industry), which describes the technology on the conventional intake apparatus for a local ventilation system, which has been descried above.

SUMMARY

Embodiments of the invention provide an intake apparatus for a local ventilation system which is able to enhance an air flow speed inside an intake duct.

In particular, according to at least embodiment, there is provided an intake apparatus for a local exhaust system, which includes a connection opening, a hood configured to connect an intake opening larger than the connection opening, an intake duct coupled to the hood while communicating with the connection opening; and an intake fan which is installed at a peripheral portion of the intake opening so as to generate an intake air current in the direction of the connection opening, wherein the intake fan is provided multiple in number in the circumference direction of the intake opening so as to generate an intake air current flowing from the intake opening to the connection opening, and a mixed flow prevention body is formed protruding in a partition shape from the intake opening to the intake duct along the inner side of a corner of the hood, and a plurality of lattice exhaust guide flow passages are disposed on straight lines and are isolated from each other, and an air current alignment lattice is installed in the inner space of the intake duct for the lattice exhaust guide flow passage to be disposed in the longitudinal direction of the intake duct.

In order to reduce any interference between the air currents generated by each intake fan in a stage before it enters into the fixed lattice exhaust guide flow passage, there may be further provided an upper guide opening, which is smaller than the connection opening; and an air current interference release skirt part which is formed extending from the lower side of the air current alignment lattice so as to connect the lower guide opening larger than the upper guide opening.

Moreover, it is preferred that a plurality of the intake fans include a pair of horizontal side intake fans installed at a horizontal side of the intake opening, and a pair of vertical side intake fans installed at a vertical side of the intake opening, and there are further provided a pair of air current interference release wing parts which extend from the lower side of the air current alignment lattice so as to reach any of a pair of the horizontal side intake fans and a pair of the vertical side intake fans.

In addition, in order to select the length of the lattice exhaust guide flow passage matching with the speed of the air current generated by each intake fan, the air current alignment lattice may include a fixed lattice part which is fixedly installed in an inner space of the intake duct in such a way that a plurality of fixed lattice exhaust guide flow passages are disposed on straight lines and are isolated from each other, and the fixed lattice exhaust guide flow passages are disposed in the longitudinal direction of the intake duct; and a movable lattice part which is installed inside of the intake duct in such a way that a plurality of movable lattice exhaust guide flow passages disposed on straight lines and isolated from each other are formed corresponding to the fixed lattice exhaust guide flow passages, and the movable lattice exhaust guide flow passages are overlapped over the fixed lattice exhaust guide flow passages and can be movable in the longitudinal direction of the intake duct.

In order to measure select the length of the lattice exhaust guide flow passage better matching with the speed of the air current generated by each intake fan and measure the speed of the air current passing through the inside of the hood, there may be preferably further provided an air current speed sensor installed inside of the hood so as to measure the speed of an air current passing through the inside of the hood; a lattice driving part which is able to move the movable lattice part in the longitudinal direction of the intake duct; and a control part which is configured to control the lattice driving part in order for the driving lattice part to move to where the overlapping section between the movable lattice exhaust guide flow passages and the fixed lattice exhaust guide flow passages to relatively decrease if the speed of the air current passing through the inside of the hood increases judging by the measured value of the air current speed sensor.

BRIEF DESCRIPTION OF DRAWINGS

These and other features, aspects, and advantages of the invention are better understood with regard to the following Detailed Description, appended Claims, and accompanying Figures. It is to be noted, however, that the Figures illustrate only various embodiments of the invention and are therefore not to be considered limiting of the invention's scope as it may include, other effective embodiments as well.

DETAILED DESCRIPTION

Figure 1:
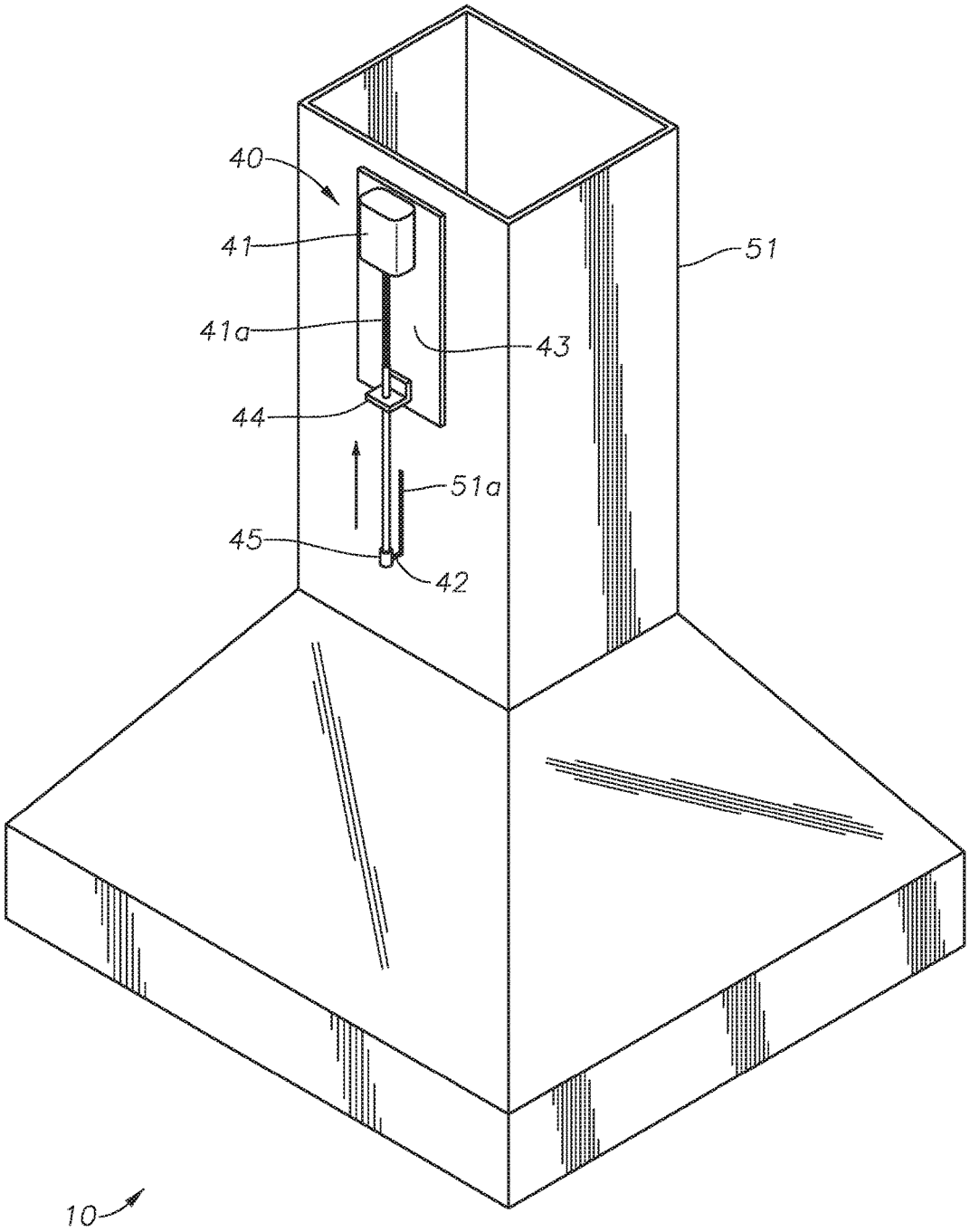
FIG. 1 is a perspective view illustrating an intake apparatus for a local ventilation system according to an embodiment of the invention.

Advantages and features of the invention and methods of accomplishing the same will be apparent by referring to embodiments described below in detail in connection with the accompanying drawings. However, the invention is not limited to the embodiments disclosed below and may be implemented in various different forms. The embodiments are provided only for completing the disclosure of the invention and for fully representing the scope of the invention to those skilled in the art.

For simplicity and clarity of illustration, the drawing figures illustrate the general manner of construction, and descriptions and details of well-known features and techniques may be omitted to avoid unnecessarily obscuring the discussion of the described embodiments of the invention. Additionally, elements in the drawing figures are not necessarily drawn to scale. For example, the dimensions of some of the elements in the figures may be exaggerated relative to other elements to help improve understanding of embodiments of the invention. Like reference numerals refer to like elements throughout the specification.

Embodiments of the invention will be described below, but the invention is not limited to the embodiments described below, and it should be understood that the scope of the invention includes various embodiments in which the embodiments described below are modified, improved, or changed as appropriate, based on the ordinary knowledge of those skilled in the art, within the scope not deviating from the spirit of the invention.

Embodiments of the invention provide an intake apparatus for a local exhaust system, which may include, but is not limited to, a connection opening, a hood configured to connect an intake opening larger than the connection opening, an intake duct coupled to the hood while communicating with the connection opening, and an intake fan which is installed at a peripheral portion of the intake opening so as to generate an intake air current in the direction of the connection opening, wherein the intake fan is provided multiple in number in the circumference direction of the intake opening so as to generate an intake air current flowing from the intake opening to the connection opening, and a mixed flow prevention body is formed protruding in a partition shape from the intake opening to the intake duct along the inner side of a corner of the hood, and a plurality of lattice exhaust guide flow passages are disposed on straight lines and are isolated from each other, and an air current alignment lattice is installed in the inner space of the intake duct for the lattice exhaust guide flow passage to be disposed in the longitudinal direction of the intake duct.

Figure 2:
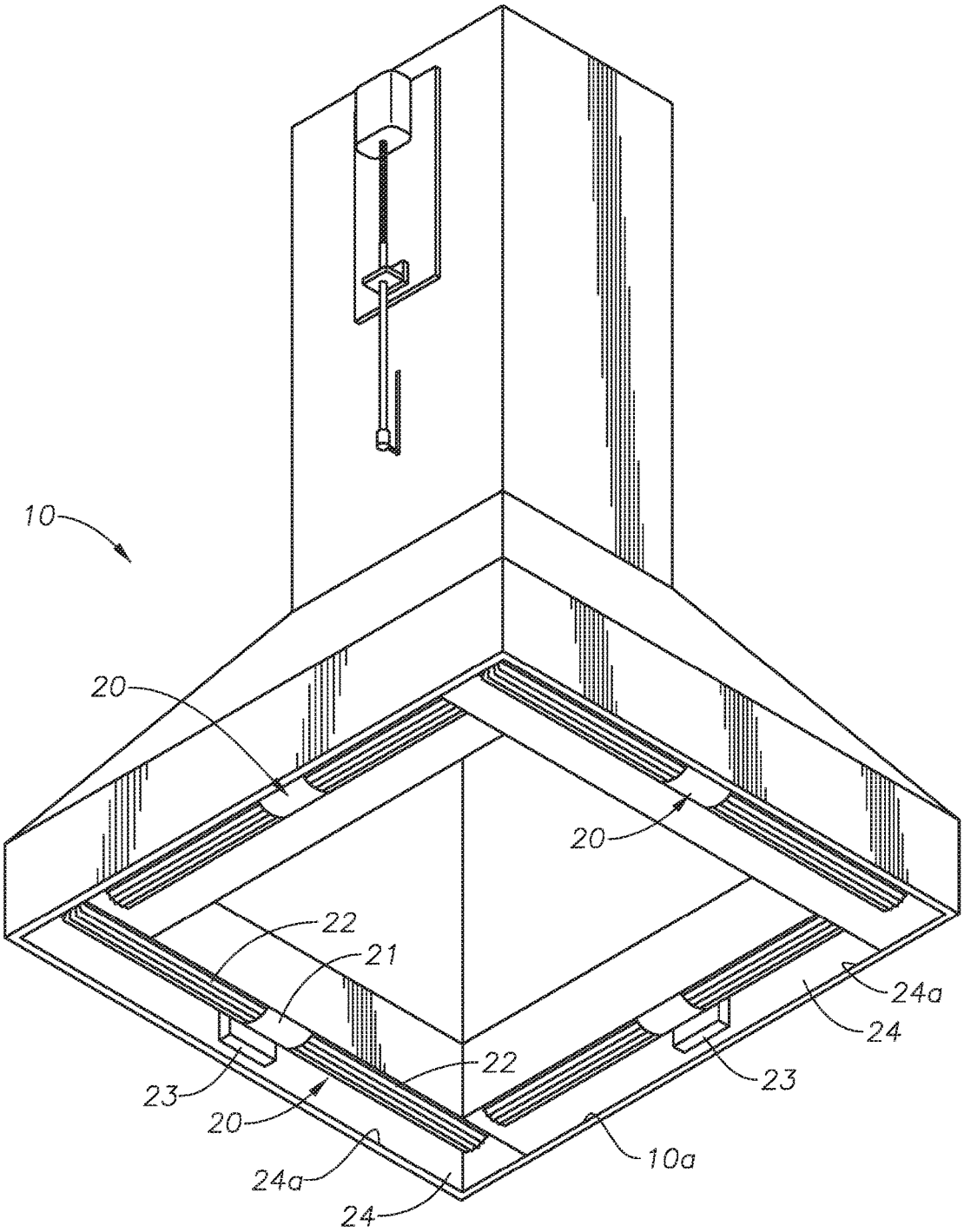
FIG. 2 is another perspective view illustrating an intake apparatus for a local ventilation system according to an embodiment of the invention.
Figure 3:
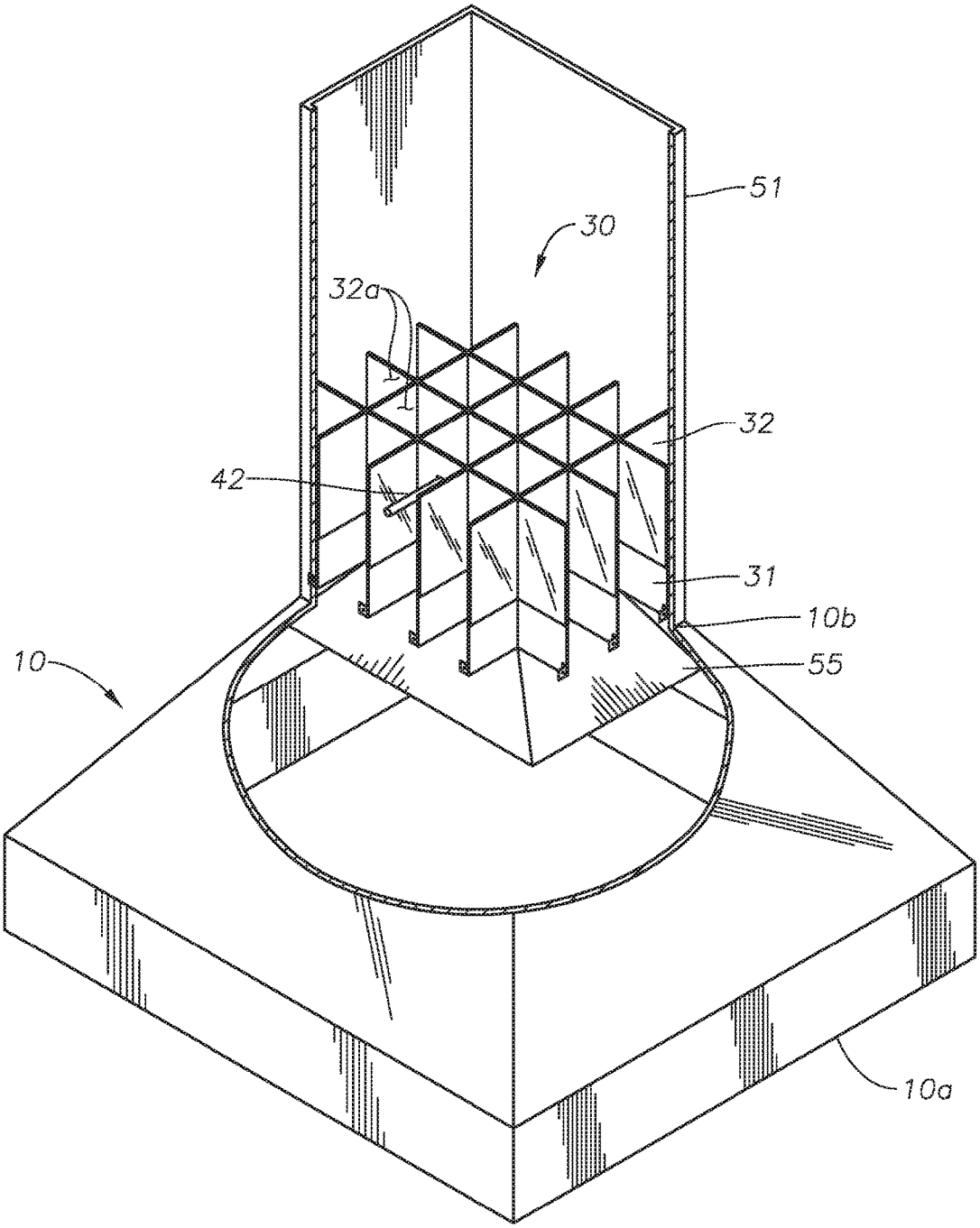
FIG. 3 is a partially cut-away perspective view illustrating an intake apparatus for a local ventilation system according to an embodiment of the invention.
Figure 4:
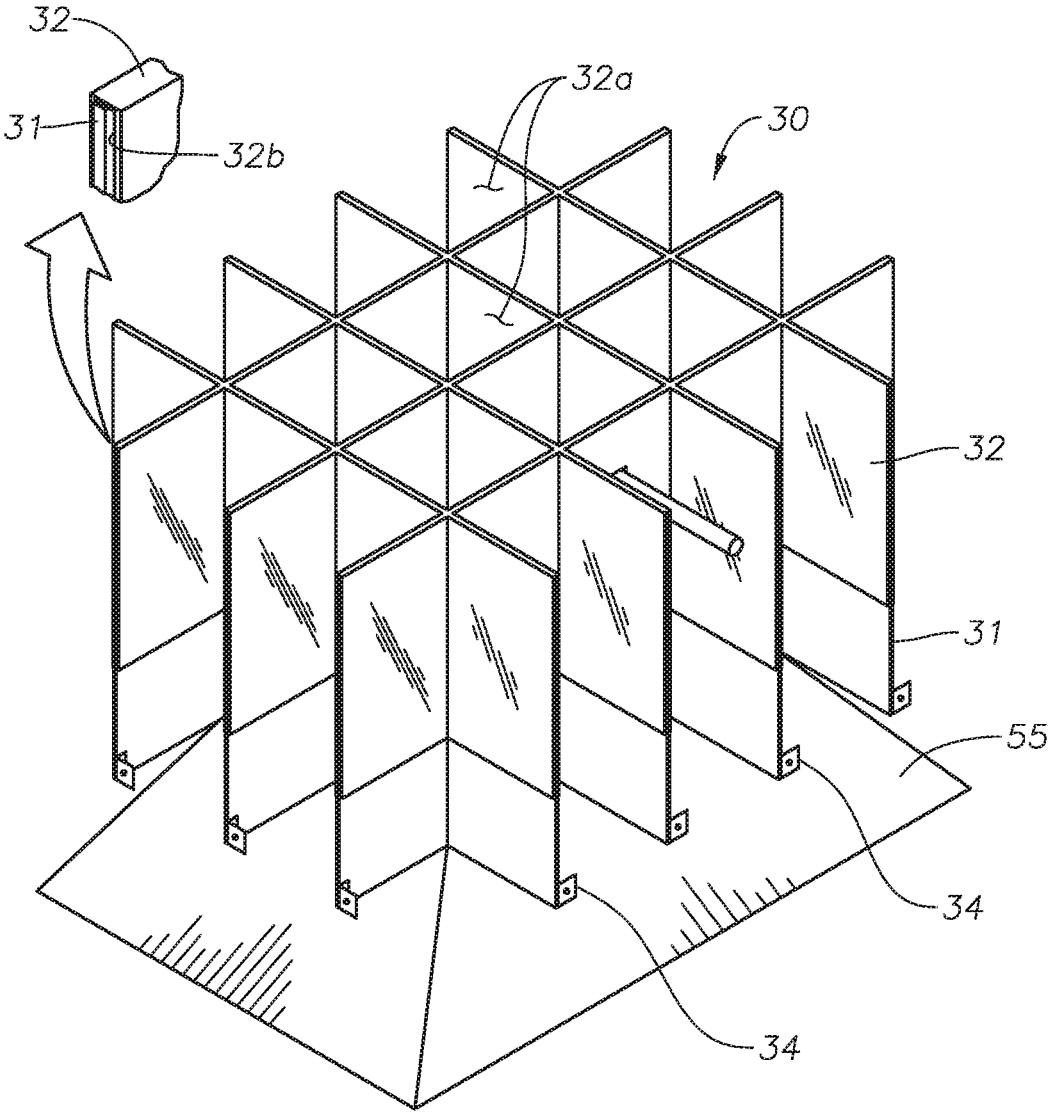
FIG. 4 is a view illustrating an air current alignment lattice according to an embodiment of the invention.
Figure 5:
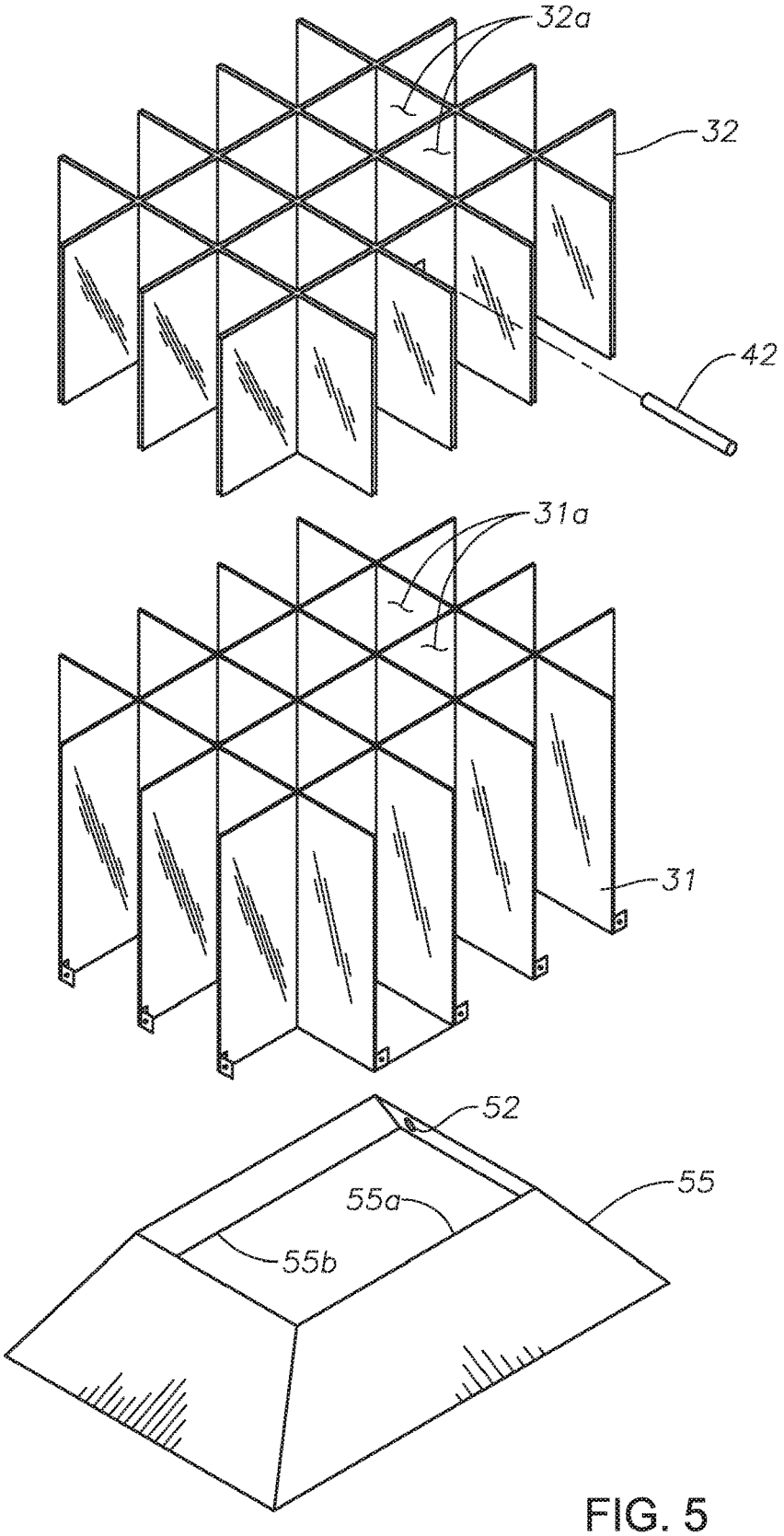
FIG. 5 is another view illustrating an air current alignment lattice according to an embodiment of the invention.
Figure 6:
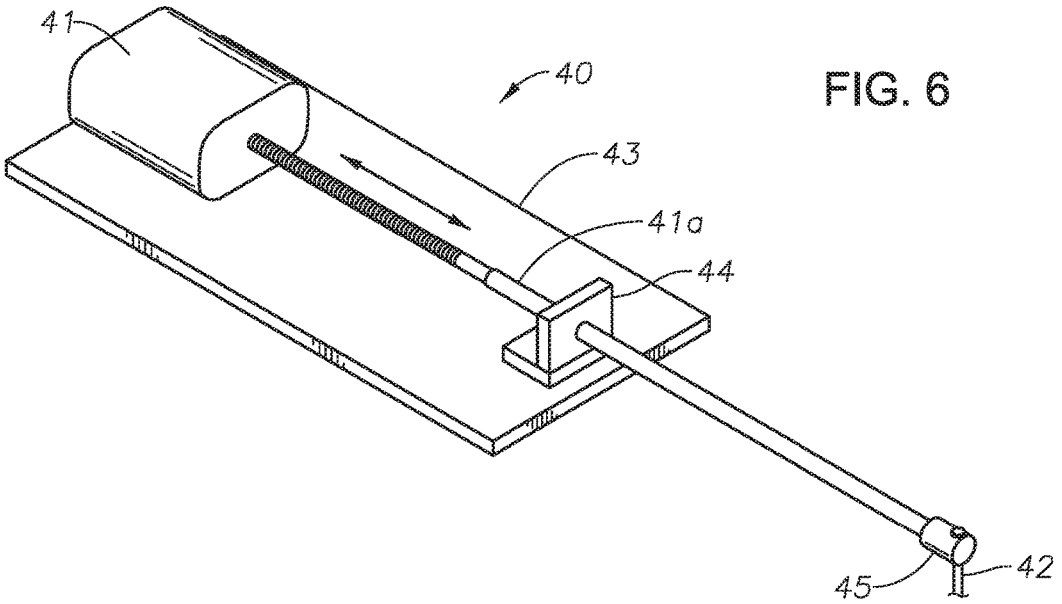
FIG. 6 is a view illustrating a lattice driving part according to an embodiment of the invention.
Figure 7:
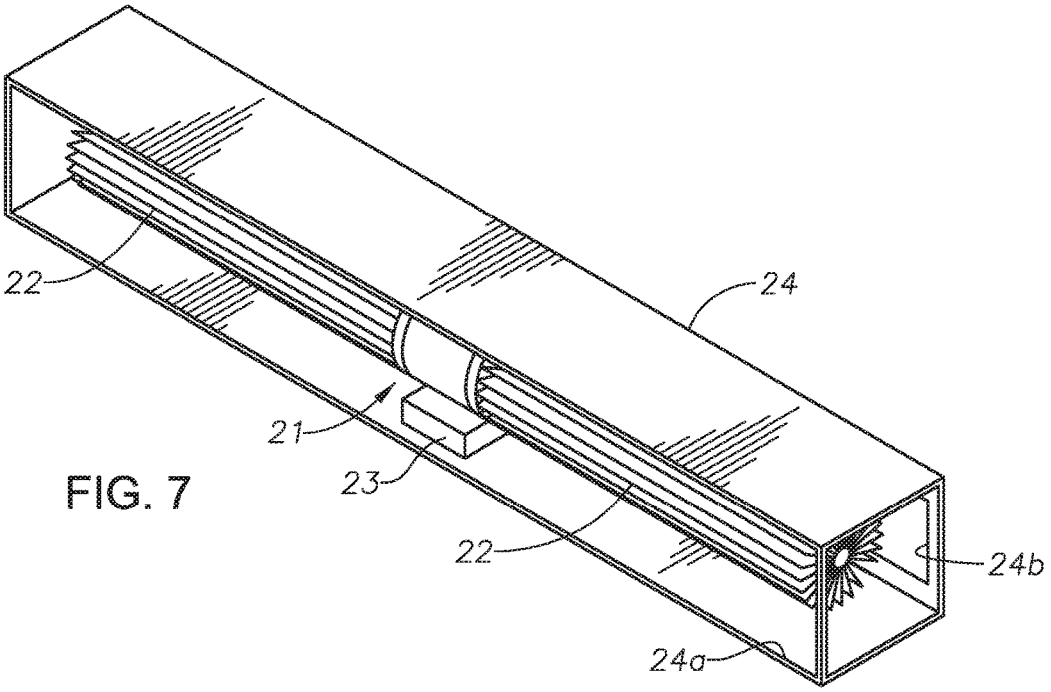
FIG. 7 is a view illustrating an intake fan according to an embodiment of the invention.
Figure 8:
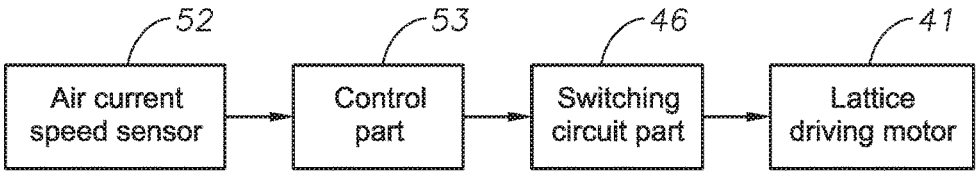
FIG. 8 is a control block diagram according to an embodiment of the invention.

FIGS. 1 and 2 are perspective views illustrating an intake apparatus for a local ventilation system according to an embodiment of the invention, FIG. 3 is a partially cut-away perspective view illustrating an intake apparatus for a local ventilation system according to an embodiment of the invention, FIGS. 4 and 5 are views illustrating an air current alignment lattice according to an embodiment of the invention, FIG. 6 is a view illustrating a lattice driving part according to an embodiment of the invention, FIG. 7 is a view illustrating an intake fan according to an embodiment of the invention, and FIG. 8 is a control block diagram according to an embodiment of the invention.

As illustrated in the drawings, the intake apparatus for a local ventilation system according to an embodiment of the invention may include, but is not limited to, a connection opening 10*b*, a hood 10 formed to connect an intake opening 10*a*, an intake duct 51 coupled to the hood 10, four intake fans 20 installed at a peripheral region of the intake opening 10*a*, an air current alignment lattice 30 installed in the inner space of the intake duct 51, an air current interference release skirt part 55 formed extending from the lower side of the air current alignment lattice 30, an air current speed sensor 52 installed inside of the hood 10, a lattice driving part 40 configured to supply, to a driving lattice part 32, a driving force, which may allow the driving lattice part 32 to move in the longitudinal direction of the intake duct 51, and a control part 53 configured to control the lattice driving part 40 based on the measured values of the air current speed sensor 52.

According to at least one embodiment, the intake opening 10*a* of the hood 10 is formed in a rectangular shape larger than the connection opening 10*b*.

According to at least one embodiment, the intake duct 51 may be formed in a rectangular shape.

According to at least one embodiment, a guide longitudinal hole 51*a* may be formed in the longitudinal direction at the intake duct 51.

According to at least one embodiment, the intake duct 51 may be coupled to the hood 10 while communicating with the connection opening 10*b*.

According to at least one embodiment, each intake fan 20 may be equipped with a fan driving motor 21, and an impeller 22 installed at both sides of the fan driving motor 21 to rotate together when a motor shaft rotates.

According to at least one embodiment, each of the thusly constituted intake fan 20 is installed one by one inside of tour fan housings 24 using a support member 23.

According to at least one embodiment, the fan housing 24 may be installed at the hood 10 in such a way that an inflow opening 24*a* and a discharge opening 24*b* formed separate at the opposite planes are disposed in parallel at the intake opening 10*a*.

According to at least one embodiment, the fan housing 24 may be installed one by one at the four sides of the intake opening 10*a*.

According to at least one embodiment, each intake fan 20 may be installed inside of the fan housing 24 so that the motor shaft of the fan driving motor 21 can be disposed in the longitudinal direction of the fan housing 24.

According to at least one embodiment, the fan driving motor 21 may be configured to operate in order for the impeller 22 to rotate in the arrow direction indicated in FIG. 2 when the driving voltage is supplied. So, the intake fan 20 may create an intake air current from the intake opening 10*a* to the connection opening 10*b*.

According to at least one embodiment, a mixed flow prevention member (not illustrated) formed protruding in a partition shape from the intake opening 10*a* to the intake duct 51 along the inner side of the corner of the hood 10 may extend to both sides from an end of a mixed flow prevention body (not illustrated thus preventing a mixed flow between the neighboring intake fans 20 installed at the intake opening 10*a*.

According to at least one embodiment, similar to the conventional technology configuration, a filter (not illustrated) may be installed inside of the fan housing 24.

According to at least one embodiment, the air current alignment lattice 30 may include a fixed lattice part 31 fixedly installed in the inner space of the intake duct 51, and a movable lattice part 32 which is installed inside of the intake duct 51 to be movable in the longitudinal direction of the intake duct 51.

According to at least one embodiment, a plurality of fixed lattice exhaust guide flow passages 31*a* may be formed at the fixed lattice part 31, which are disposed on straight lines and are isolated from each other.

According to at least one embodiment, the constituted fixed lattice part 31 may be installed in the inner space of the intake duct 51 in such a way to fix a fixing piece 34 at the intake duct 51. The installation of the lattice part 31 may allow the fixed lattice exhaust guide flow passage 31*a* to be disposed in the longitudinal direction of the intake duct 51.

According to at least one embodiment, the movable lattice part 32 may be disposed for a plurality of the movable lattice exhaust guide flow passages 32*a* to correspond to the fixed lattice exhaust guide flow passages 31*a*, wherein a plurality of the movable lattice exhaust guide flow passages 12*a* are disposed on straight lines in the upward directions and are isolated from each other. The movable lattice part 32 may be manufactured integral (for the sake of the movement of whole components) to have a sliding groove 32*b* into which a part of the fixed lattice part 31 may enter.

According to at least one embodiment, the movable lattice part 32 may be installed inside of the intake duct 51 for a part of the fixed lattice part 31 to enter, so the movable lattice exhaust guide flow passage 32*a* may be overlapped over the fixed lattice exhaust guide flow passage 31*a*, and the movable lattice part 32 may become movable in the longitudinal direction of the intake duct 51.

According to at least one embodiment, the contours of the side surfaces of the fixed lattice part 31 and the movable lattice part 32 may be formed in rectangular shapes like the intake duct 51.

According to at least one embodiment, the air current interference release skirt part 55 may be configured to connect an upper guide opening 55*a* smaller than the connection opening 10*b* and a lower guide opening 55*b* larger than the upper guide opening 55*a*.

According to at least one embodiment, the upper guide opening 55*a* and the lower guide opening 55*b* may be formed in rectangular shapes.

According to at least one embodiment, the air current discharged from the intake fan 20 may flow into the lower guide opening 55*b* of the air current interference release skirt part 55 and can flow into the air current alignment lattice 30 without causing any air current collision from the intake duct 51.

According to at least one embodiment, the air current speed sensor 52 may be installed at the top of the inner surface of the air current interference release skirt part 55.

According to at least one embodiment, the air current speed sensor 52 is able to measure the speed of the air current flowing from the intake duct 10*a* to the connection opening 10*b* and transfer to the control part 53.

According to at least one embodiment, the lattice driving part 40 may include a switching circuit party 46 connected to the control part 53, a lattice driving motor 41 connected to the switching circuit part 46, and a connection rod 42 coupled to the movable lattice part 32 to be exposed to the outside of the intake duct 51 via the guide longitudinal hole 51*a*.

According to at least one embodiment, the switching circuit part 46 is connected with an external power, and is able to selectively generate a normal direction rotation driving voltage or a reverse direction rotation driving voltage in response to a control signal from the control part 53 and supplies it to the lattice driving motor 41. Since the operation of the switching circuit part 46 is known, the detailed description thereof will be omitted.

According to at least one embodiment, the lattice driving motor 41 may be rotated in the normal or reverse direction and is equipped with a lead screw 41*a* which may move forward or backward based on the rotation direction. Since the lattice driving motor 41 having such functions are described in the Korean patent registration number 10-0155025 (the title of the invention is a motor for a transportation, the date of the registration is Jul. 13, 1998), the detailed description thereof will be omitted.

According to at least one embodiment, the lattice driving motor 41 may be installed at an outer surface of the intake duct 51 through a support, plate 43 and a bracket 44.

According to at least one embodiment, the connection rod 42 is coupled to a terminal end of the lead screw 41*a* through the connection block 45.

According to at least one embodiment, the thusly constituted lattice driving part 40 may be configured in such a way that the lead screw 41*a* moves forward or backward when a driving voltage is supplied to the lattice driving motor 41, and a driving force can be supplied to the movable lattice part 32, which driving force may allow to move the movable lattice part 32 to move in the longitudinal direction of the intake duct 51.

According to at least one embodiment, the control part 53 may be equipped with an input terminal connected to the air current speed sensor 52, and an output terminal connected to the swimming circuit part 46.

According to at least one embodiment, the control part 53 is able to control the lattice driving part 40 so as to move the movable lattice part 32 to where the overlapping section becomes relatively smaller between the movable lattice exhaust guide flow passage 32*a* and the fixe lattice exhaust guide flow passage 31*a* if the speed of the air current passing through the inside of the hood 10 increases based on the measured value of the air current speed sensor 52.

For example, the control part 53 may be configured to control the lattice driving part 40.

For the sake of convenient descriptions, the movable lattice part 32 at an initial stage is installed to be disposed where the overlapping section is largest between the movable lattice exhaust guide flow passage 32*a* and the fixed lattice exhaust guide flow passage 31*a*. It may be assumed that if it is disposed where the overlapping section is largest between the movable lattice exhaust guide flow passage 32*a* and the fixed lattice exhaust guide flow passage 31*a*, the speed (hereinafter referred to as "a reference speed value") of the internal air current of the hood 10 where the air current alignment operation of the air current alignment lattice 30 can occur effectively may be selected as an actually measured value (by a method wherein the intake apparatus for a local ventilation system of the invention at various air current speeds, and an exhaust efficiency is measured over the whole system at each air current speed) or a theoretical value and may be stored in a memory (not illustrated).

First, if the measured value from the air current speed sensor 52 is smaller than a reference speed value, the control part 53 will control the switching circuit part 46 for the motor driving voltage not to be supplied to the lattice driving motor 41.

Subsequently, the control part 53 may control the switching control part 46 in such a way that if the measured value (hereinafter referred to as "a first measured value") inputted from the air current speed sensor 52 is larger than a reference speed value (preferably, if it is larger than a predetermined reference value), a difference between the first measured value and the reference speed value is calculated, and the rotation driving voltage of the normal direction (the direction that a rotor of the lattice driving motor rotates for the lead screw to move toward the direction that it moves receding from the intake opening, namely, the direction that the rotor of the lattice driving motor rotates for the driving lattice part to move toward the direction that the overlapping section decreases between the movable lattice exhaust guide flow passage and the fixed lattice exhaust guide flow passage) is applied to the lattice driving motor 41. Here, the control part 53 may control the switching circuit part 46 for the applying time of the rotation driving voltage of the normal direction to increase if a difference between the first measured value and the reference speed value is large (a proportional increase is not necessarily required).

Next, the control part 53 may control the switching circuit party 46 in such a way that if the measured value (hereinafter referred to as "a second measured value") inputted from the air current speed sensor 52 is larger than the first measured value (preferably, it is larger than a predetermined reference value), a difference between the second measured value and the first measured value is calculated, and the rotation driving voltage of the normal direction (the direction that the rotor of the lattice driving motor rotates for the lead screw to move toward the direction receding from the intake opening, namely, the direction that the rotor of the lattice driving motor rotates for the movable lattice part to move to the direction where the overlapping section between the movable lattice exhaust guide flow passage and the fixed lattice exhaust guide flow passage decreases) is applied to the lattice driving motor 41. The control part 53 may control the switching circuit part 46 in such a way that the applying time of the rotation driving voltage of the normal direction increases if a difference between the first measured value and the second measured value is high (a proportional increase is not necessarily required).

Meanwhile, the control part 53 may control the switching circuit part 46 in such a way that if the measured value (hereinafter referred to as "a third measured value") inputted from the air current speed sensor 52 is smaller than the first measured value (preferably, it is smaller than a predetermined reference value), a difference between the third measured value and the first measured value is calculated, and then the rotation driving voltage of the reverse direction (the direction that the rotator of the lattice driving motor rotates for the lead screw to move to the direction approaching the intake opening, namely, the direction that the rotor of the lattice driving motor rotates for the movable lattice part to move toward the direction that the overlapping section between the movable lattice exhaust guide flow passage and the fixed lattice exhaust guide flow passage increases) is applied to the lattice driving motor 41. The control part 53 may control the switching circuit part 46 for the applying time of the reverse direction rotation driving voltage to increase if the difference between the first measured value and the third measured value is large.

In the intake apparatus for a local ventilation system according to an embodiment of the invention, the intake opening 10*a* and the connection opening 10*b* of the hood 10 may be installed in parallel at the floor surface of a building, and the operation thereof will be described.

First, a driving voltage is supplied to the fan driving motor 21. If a driving voltage is supplied to the fan driving motor 21, an intake air current is generated by each intake fan 20 from the intake opening 10*a* to the connection opening 10*b*.

Subsequently, the air current speed sensor 52 will measure the speed of the air current which passes through the inside of the hood 10 and transfer to the control part 53.

According to at least one embodiment, the control part 53 will control the lattice driving part 40 (a switching circuit part) by the previously described method based on the measured value of the air current speed sensor 52.

Meanwhile, the intake air current generated by each intake fan 20 may be divided and inputted into the fixed lattice exhaust guide flow passage 31*a* through a space formed between the connection opening 10*b* or the air current interference release skirt part 55 and the hood 10.

Since the intake air current generated by each intake fan 20 is divided and inputted into the fixed lattice exhaust guide flow passage 31*a*, an interference between the air currents generated by each intake fan 20 can be minimized, which interference may occur when the intake air current passes through the connection opening 10*b*.

Since a part of the intake air current generated by each intake fan 20 is divided and inputted into the fixed lattice exhaust guide flow passage 31*a* through a space between the air current interference release skirt part 55 and the inner surface of the hood 10, an interference between the air currents generated by each intake fan 20 can be minimized in a stage before it enters into the fixed lattice exhaust guide flow passage 31*a*, whereby the intake air current can smoothly enter into the fixed lattice exhaust guide flow passage 31*a*.

According to at least one embodiment, the intake air current (hereinafter referred to "a divided air current") which has been divided and entered into the fixed lattice exhaust guide flow passage 31*a* may be discharged into the inside of the intake duct 51 through the fixed lattice exhaust guide flow passage 31*a* connected to each fixed lattice exhaust guide flow passage 31*a*.

According to at least one embodiment, the divided air current may be aligned in parallel when passing through the fixed lattice exhaust guide flow passage 31*a* and the movable lattice exhaust guide flow passage 32*a*, which makes it possible to minimize any interference between the divided air currents discharged into the inside of the intake duct 51, so the flow of the air current can become smooth inside of the intake duct 51.

Meanwhile, while it has been described that the intake opening 10*a* and the connection opening 10*b* of the hood 10 and the intake duct 51 are all formed in rectangular shapes in the previously described embodiment, the invention may be implemented alternatively in such a way that the intake opening 10*a* of the hood 10 may be formed in a rectangular shape, and the connection opening 10*b* of the hood 10 and the intake duct 51 may be formed in another shape, for example, a triangle shape, etc.

Figure 9:
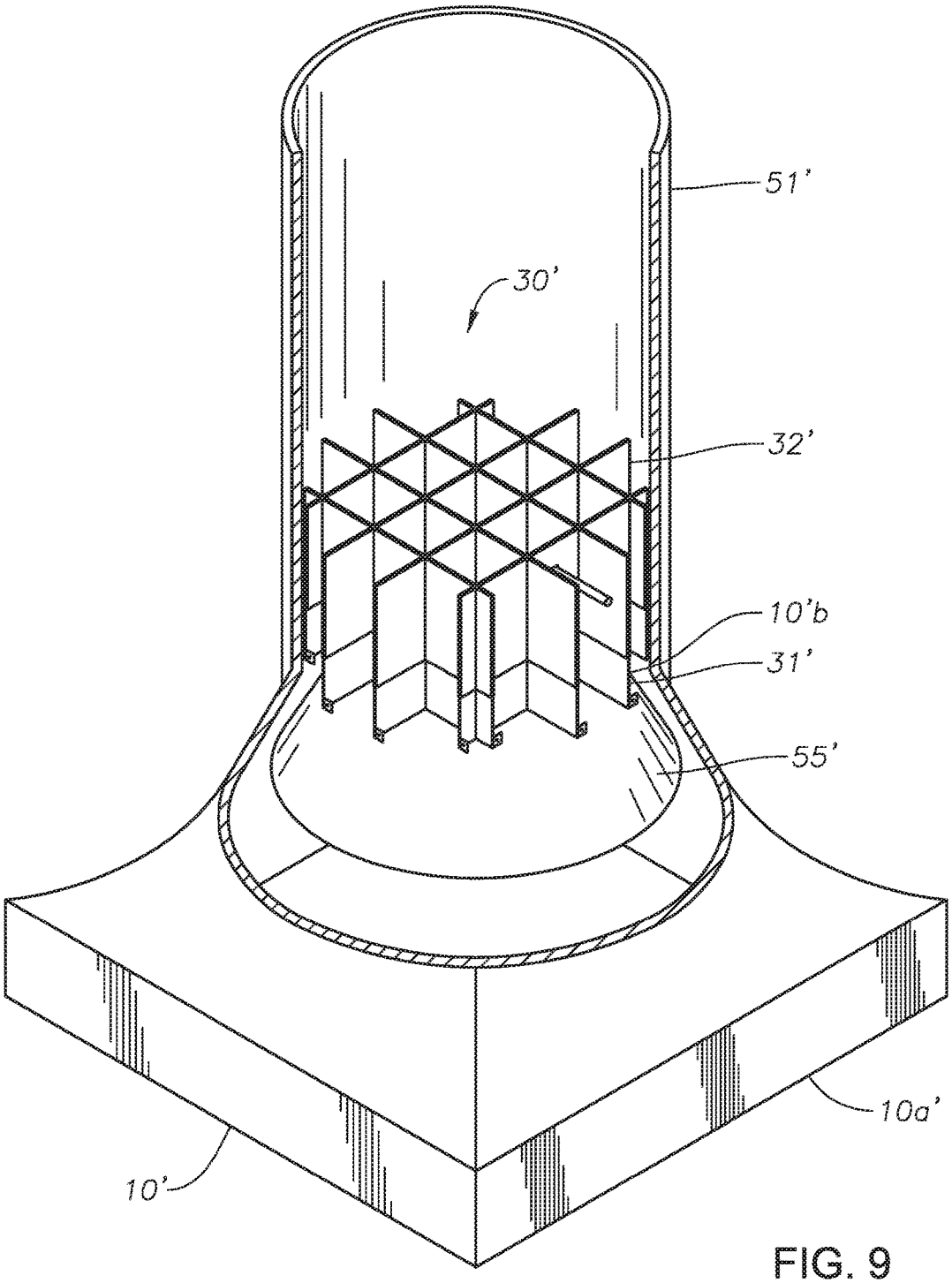
FIG. 9 is a partially cut-away perspective view illustrating an intake apparatus for a local ventilation system according to another embodiment of the invention.
Figure 10:
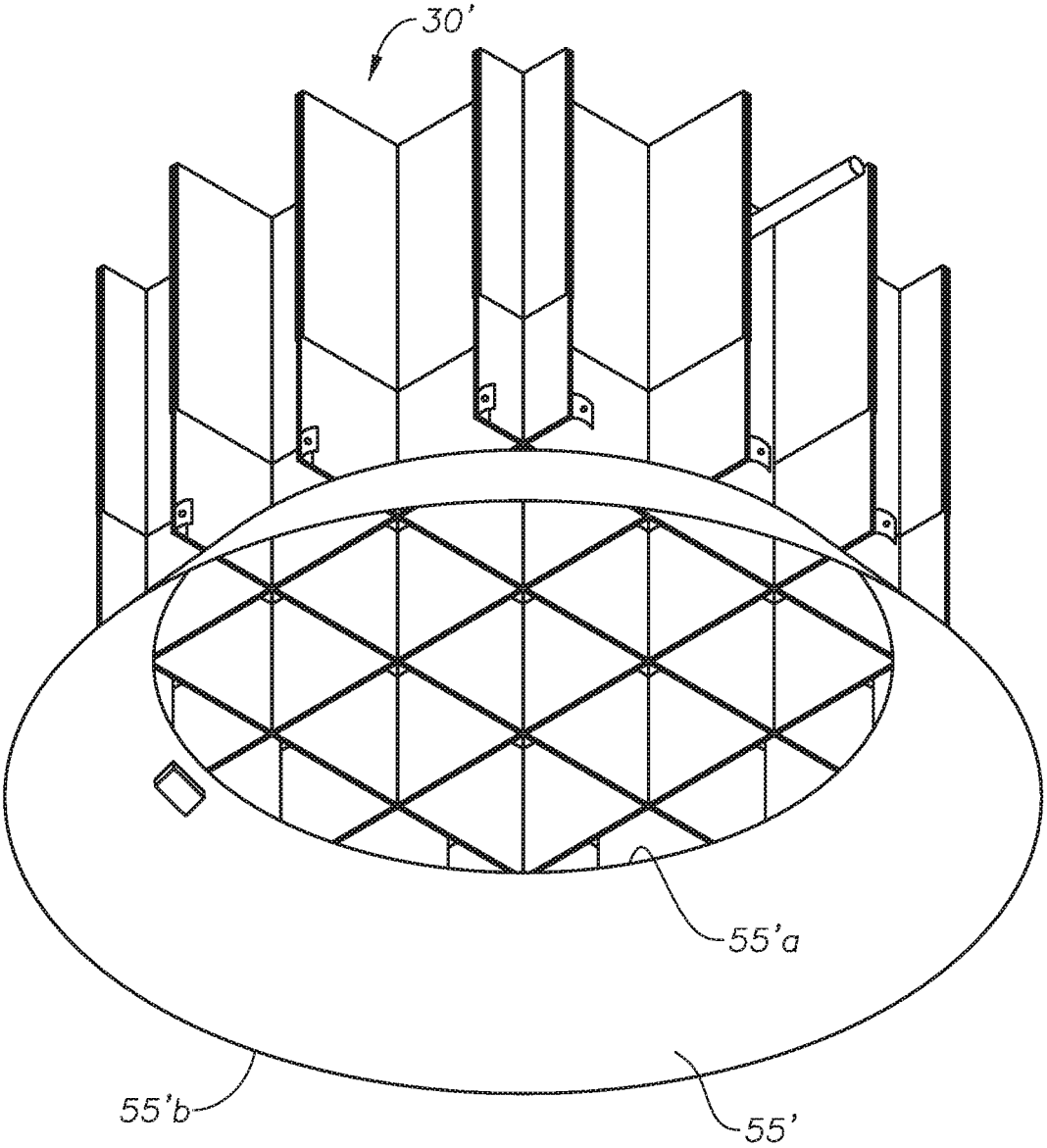
FIG. 10 is a view illustrating an air current alignment lattice according to another embodiment of the invention.

FIG. 9 is a partially cut-away perspective view illustrating an intake apparatus for a local ventilation system according to another embodiment of the invention, and FIG. 10 is a view illustrating an air current alignment lattice according to another embodiment of the invention.

In the intake apparatus for a local ventilation system according to another embodiment of the invention, the remaining components except for a hood 10', an air current alignment lattice 30', an intake duct 51' and an air interference release skirt part 55' are same as the intake apparatus for a local ventilation system according to an embodiment of the invention.

According to at least one embodiment, the intake opening 10'*a* of the hood 10' of the intake apparatus for a local ventilation system according to another embodiment of the invention may be formed in a rectangular shape.

According to at least one embodiment, the connection opening 10'*b* of the hood 10' may be formed in a circular shape.

According to at least one embodiment, the upper side of the hood 10' may be formed in a conical shape the upper side of which is cut away to connect the rectangular intake opening 10'*a* and the circular connection opening 10'*b*.

According to at least one embodiment, the intake duct 51' may be formed in a circular shape.

According to at least one embodiment, the contours of the side surfaces of the fixed lattice part 31' and the movable lattice part 32' are formed in circular shapes like the intake duct 51'.

According to at least one embodiment, the air current interference release skirt part 55' may be formed in a conical shape the top of which is cut away in response to the upper side of the hood 10'.

According to at least one embodiment, the upper guide opening 55'*a* and the lower guide opening 55'*b* of the air current interference release skirt part 55' are all formed in circular shapes.

According to at least one embodiment, the operation of the intake apparatus for a local ventilation system according to another embodiment of the invention is same as the operation of the intake apparatus for a local ventilation system according to an embodiment of the invention.

Figure 11:
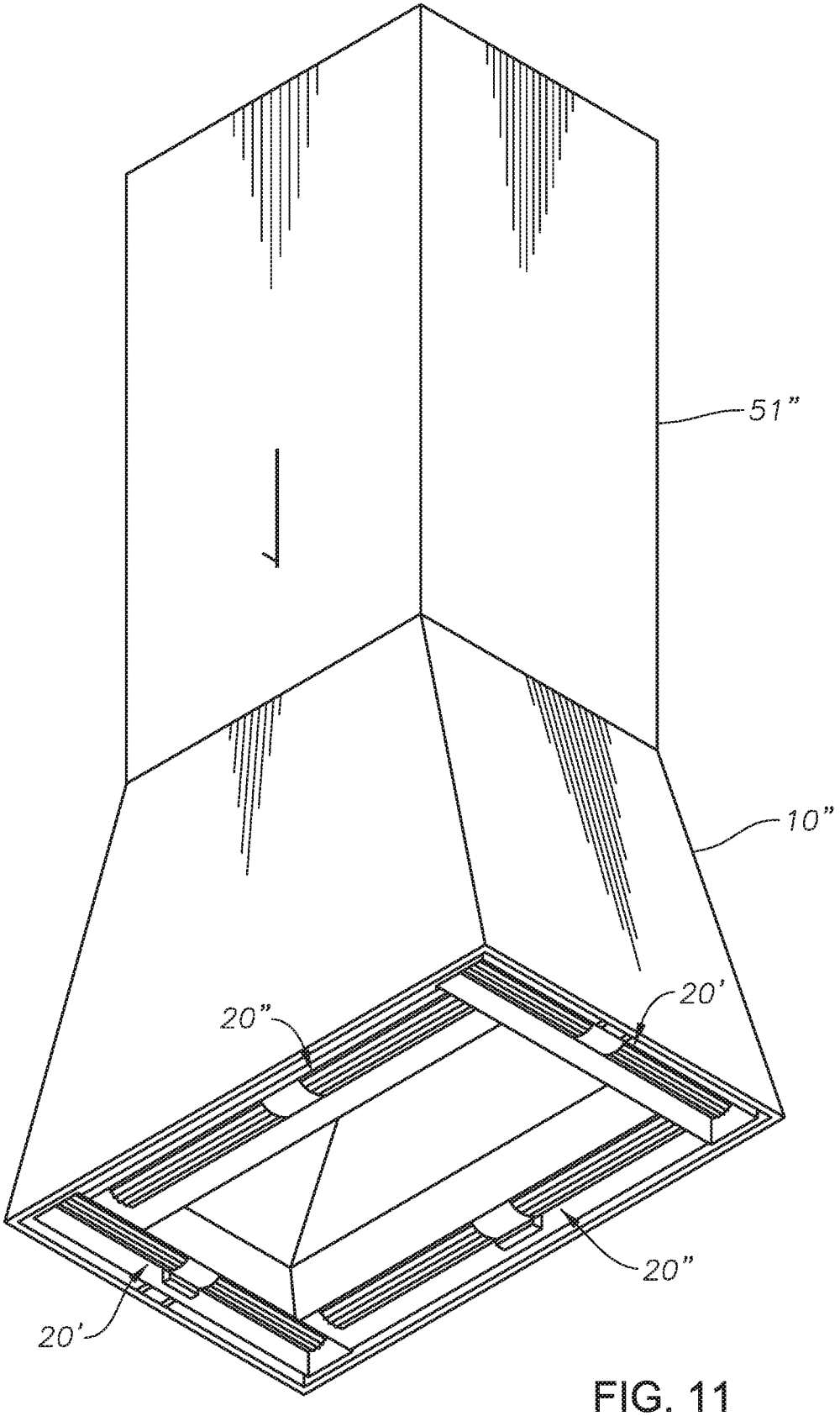
FIG. 11 is a perspective view illustrating an intake apparatus for a local ventilation system according to further another embodiment of the invention.

Moreover, the previous embodiment provides an air current interference release skirt part 55, 55' which is able to reduce any air current interference in the regions of the connection opening 10*b*, 10'*b*; however alternatively the invention may be implemented by providing a configuration which is able to reduce the air current interference in the region of the intake opening as illustrated in FIG. 11.

Figure 12:
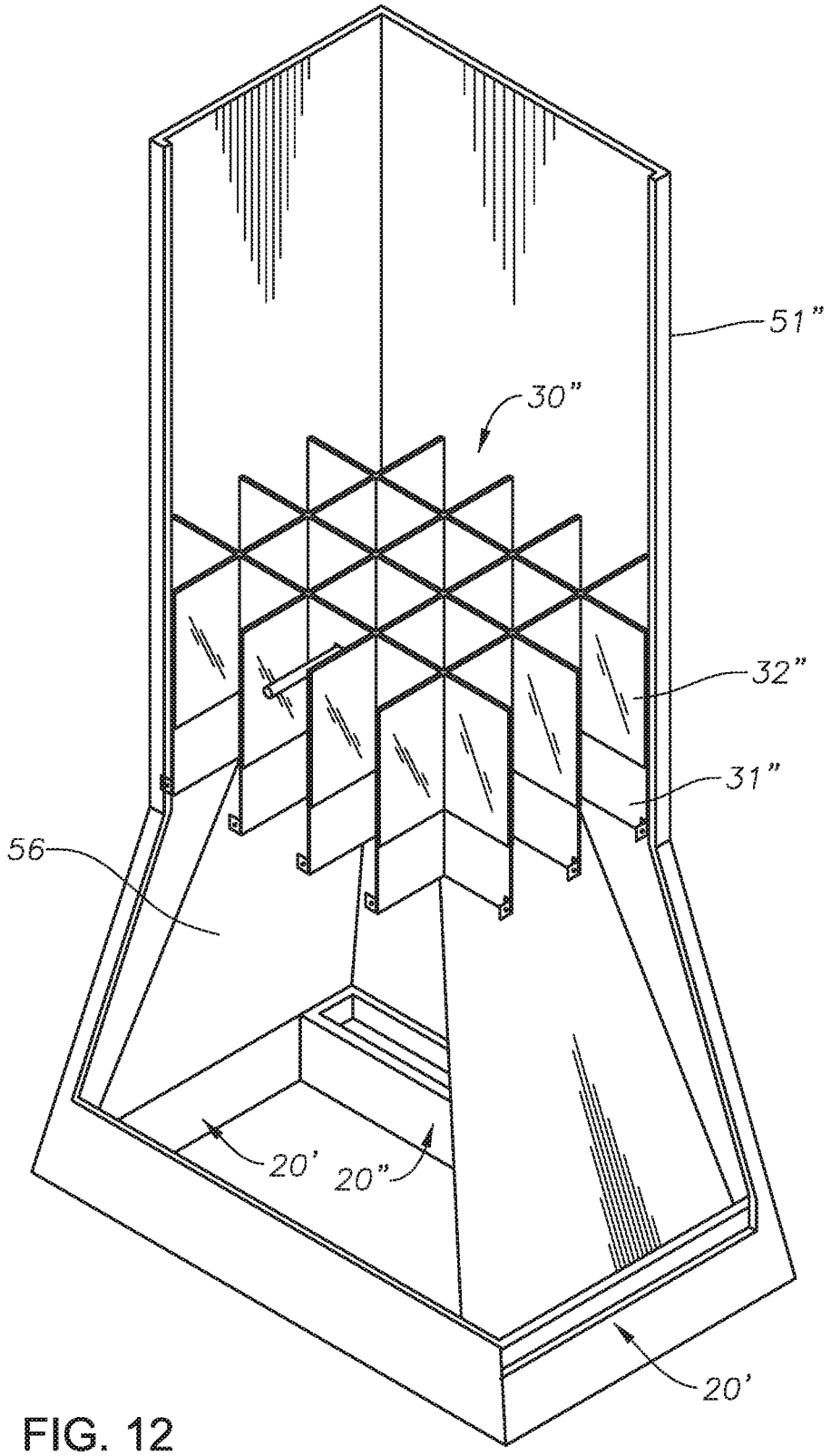
FIG. 12 is a partially cut-away perspective view illustrating an intake apparatus for a local ventilation system according to further another embodiment of the invention.
Figure 13:
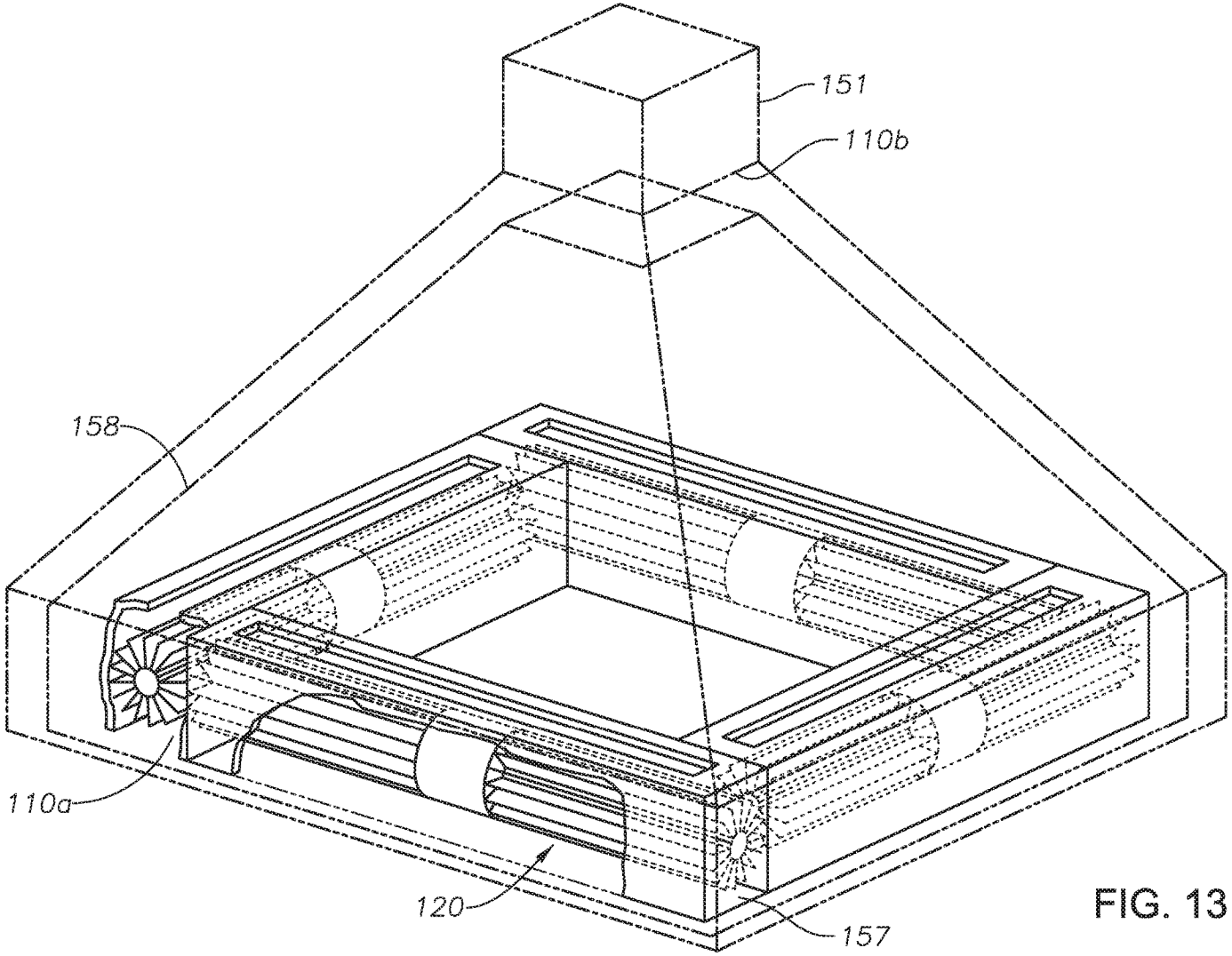
FIG. 13 is a perspective view illustrating a conventional intake apparatus for a local ventilation system.
Figure 14:
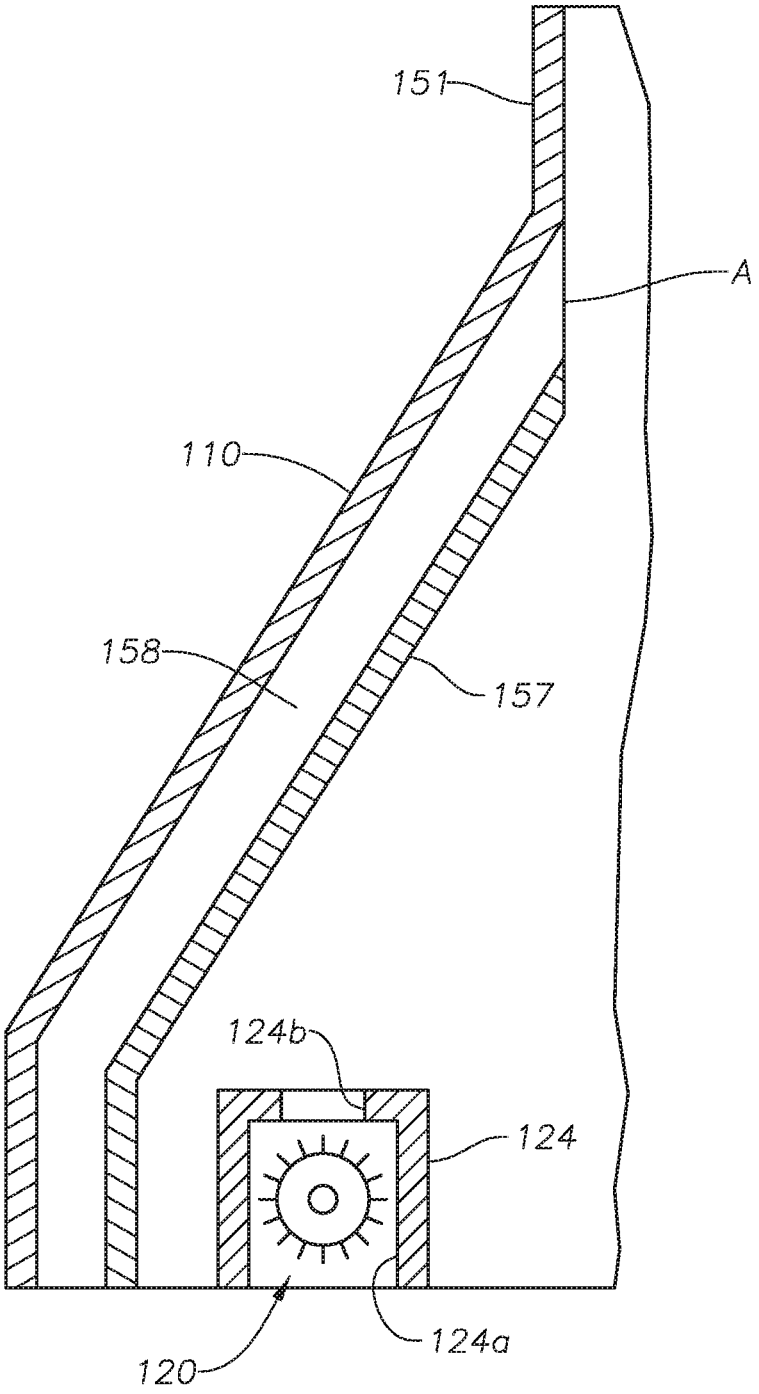
FIG. 14 is a cross sectional view illustrating the region of a hood and an isolation plate of a conventional intake apparatus for a local ventilation system.
Figure 15:
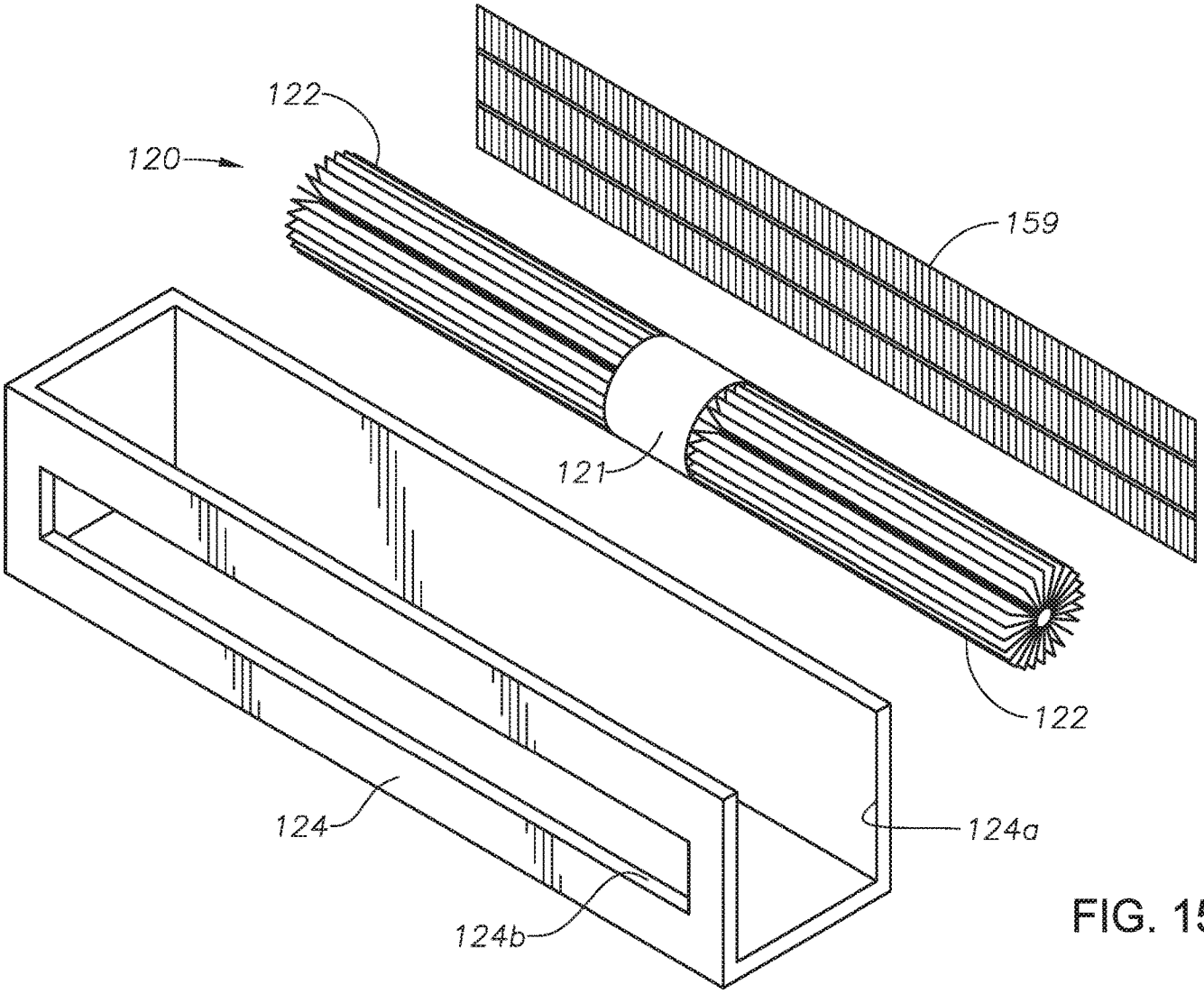
FIG. 15 is a view illustrating a conventional intake fan for a local ventilation system.

FIG. 11 is a perspective view illustrating an intake apparatus for a local ventilation system according to further another embodiment of the invention, and FIG. 12 is a partially cut-away perspective view illustrating an intake apparatus for a local ventilation system according to further another embodiment of the invention.

Except that a pair of air current interference release wing parts 56 are provided instead of the air current interference release skirt part 55, 55', the intake apparatus liar a local ventilation system according to another embodiment of the invention is same as the intake apparatus for a local ventilation system according to an embodiment of the invention.

A pair of the air current interference release wing parts 56 extend from a fixed lattice part 31" up to a pair of vertical side intake fans 20". The invention may be implemented in such a way that a pair of the air current interference release wing parts 56 extend from the fixed lattice part 31" up to a pair of horizontal side intake fans 20". A pair of the horizontal side intake fans 20" mean a pair of intake fans installed at a horizontal side of the intake opening among the intake fans, and a pair of the vertical side intake fans 20' mean a pair of intake fans installed at a vertical side of the intake opening.

According to at least one embodiment, the intake air current generated by a pair of the vertical side intake fans 20' may be guided into the fixed lattice guide flow passage through a space between a pair of the air current interference release wing parts 56 and the inner surface of the hood 10". In this way, it is possible to reduce a phenomenon in the region between the intake opening and the connection opening that the intake air current generated by a pair of the vertical side intake fans 20' in the region interferes with the intake air current generated by a pair of the horizontal side intake fans 20".

According to at least one embodiment, the intake apparatus for a local ventilation system according to further another embodiment of the invention having such a configuration may be installed in such a way that the intake opening and the connection opening of the hood 10" are disposed vertical on the floor surface of a building.

Moreover, in the previous embodiment, the lattice driving part is implemented in such a way to sue the lattice driving motor 41 having a lead screw 41*a* which move forward or backward based on the rotation direction; however alternatively, the lattice driving part may be implemented using a linear driving mechanism, for example, a hall screw, etc.

In addition, in the previous embodiment, the driving lattice part 32 is configured to be automatically moved using the air current speed sensor 52, the control part 53 and the lattice driving part 40; however alternatively the invention may be implemented in such a way that the driving lattice part 32 is configured to be moved manually.

According to the embodiment of the invention, the air current alignment lattice 30 equipped with a plurality of lattice exhaust guide flow passages 31*a* and 32*a* disposed on straight lines and isolated from each other is installed in the inner space of the intake duct 51 for the lattice exhaust guide flow passages 31*a* and 32*a* to be disposed in the longitudinal direction of the intake duct 51, thus enhancing an air flow speed inside the intake duct 51. If the air flow speed inside the intake duct 51 is enhanced, the whole exhaust efficiency of the local ventilation system can be enhanced.

There may be further provided air current interference release skirt parts 55 and 55' which extend from the lower side of the air current alignment lattice 30, by which any interference occurring between the air currents due to each intake fan 20 can be reduced in a stage before the air current enters into the fixed lattice exhaust guide flow passage 31*a*, so the air flow speed inside the intake duct 51 can be more enhanced.

Moreover, there may be further provided a pair of air current interference release wing parts 56 which extend from the lower side of the air current alignment lattice 30" to reach any of a pair of the horizontal side intake fans 20" and a pair of the vertical side intake fans 20', by which any interference occurring between the air currents due to the intake fans 20' and 20" in the region between the intake opening and the connection opening can be reduced, so the air flow speed inside the intake duct can be more enhanced.

In addition, the air alignment lattice 30 may be divided into a fixed lattice part 31 fixedly installed in the inner space of the intake duct 51 and a movable lattice part 32 installed inside the intake duct 51 so as to move in the longitudinal direction of the intake duct 51, so the length of the lattice exhaust guide flow passage can be selected to match with the speed of the air current which generates by each intake fan 20.

Furthermore, if the speed of the air current passing through the inside of the hood 10 increases judging by the measured value of the air current speed sensor 52, the movable lattice part 32 may be moved to where the overlapping section between the movable lattice exhaust guide flow passage 32*a* and the fixed lattice exhaust flow passage 31*a* becomes relatively smaller, so the length of the lattice exhaust guide flow passage can be selected to better match with the speed of the air current which is generated by each intake fan 20.

If the length of the lattice exhaust guide flow passage becomes selectable, the air flow speed inside the intake duct 51 can be stably enhanced even though the speed of the air current which is generated by each intake fan 20 changes.

Embodiments of the invention provide non-obvious advantages over the conventional art. For example, according to at least one embodiment, an air current alignment lattice having a plurality of lattice exhaust guide flow passages disposed on a straight line and isolated from each other is installed in an inner space of an intake duct in order for a lattice exhaust guide flow passage can be disposed in the longitudinal direction of the intake duct, so the flow speed of the air can be enhanced since the aid becomes a normal flow inside the intake duct. If the air flow speed is increased inside the intake duct, the whole exhaust efficiency of the local ventilation system can be enhanced.

Although embodiments of the invention have been described in detail, it should be understood that various changes, substitutions, and alterations can be made hereupon without departing from the principle and scope of the embodiments of the invention. Accordingly, the scope of the embodiments of the invention should be determined by the following claims and their appropriate legal equivalents.

I claim:

1. An intake apparatus for a local exhaust system, comprising:

a connection opening;

a hood configured to connect an intake opening larger than the connection opening;

an intake duct coupled to the hood while communicating with the connection opening; and an intake fan, which is installed at a peripheral portion of the intake opening so as to generate an intake air current in the direction of the connection opening, wherein the intake fan is provided multiple in number in the circumference direction of the intake opening so as to generate the intake air current flowing from the intake opening to the connection opening, and an air current alignment lattice is installed in an inner space of the intake duct for a lattice exhaust guide flow passage to be disposed in the longitudinal direction of the intake duct;

wherein the air current alignment lattice comprises:

a fixed lattice part which is fixedly installed in the inner space of the intake duct in such a way that a plurality of fixed lattice exhaust guide flow passages are disposed on straight lines and are isolated from each other, and the fixed lattice exhaust guide flow passages are disposed in the longitudinal direction of the intake duct;

a movable lattice part which is installed inside of the intake duct in such a way that a plurality of movable lattice exhaust guide flow passages disposed on straight lines and isolated from each other are formed corresponding to the fixed lattice exhaust guide flow passages;

an air current speed sensor installed inside of the hood so as to measure a speed of an air current passing through the inside of the hood;

a lattice driving part which is able to move the movable lattice part in the longitudinal direction of the intake duct; and a control part which is configured to control the lattice driving part in order for the driving lattice part to move to where the overlapping section between the movable lattice exhaust guide flow passages and the fixed lattice exhaust guide low passages to relatively decrease if the speed of the air current passing through the inside of the hood increases judging by the measured value of the air current speed sensor, wherein the movable lattice part is formed integrally to have a sliding groove into which a part of the fixed lattice part enters such that the movable lattice exhaust guide flow passages are overlapped over the fixed lattice exhaust guide flow passages and the movable lattice part is movable in the longitudinal direction of the intake duct to increase or decrease the overlapping section between the movable lattice exhaust guide flow passages and the fixed lattice exhaust guide flow passages.

2. The apparatus of claim 1, further comprising:

an upper guide opening which is smaller than the connection opening; and an air current interference release skirt part which is formed extending from the lower side of the air current alignment lattice so as to connect the lower guide opening larger than the upper guide opening.

3. The apparatus of claim 1, wherein a plurality of the intake fans include a pair of lengthwise direction intake fans installed in a lengthwise direction at a horizontal side of the intake opening, and a pair of widthwise direction intake fans installed in a widthwise direction at a horizontal side of the intake opening, and there are further provided a pair of air current interference release wing parts which extend from the lower side of the air current alignment lattice so as to reach any of a pair of the lengthwise direction intake fans and a pair of the widthwise direction intake fans.

* * * * *